United States Patent [19]

Filippone

[11] Patent Number: 4,787,360

[45] Date of Patent: Nov. 29, 1988

[54] ELECTRONICALLY-CONTROLLED PLASMA IGNITION DEVICE FOR INTERNAL COMBUSTION ENGINES

[75] Inventor: Claudio Filippone, Trento, Italy

[73] Assignee: EL.EN.A. S.p.A., Rovereto, Italy

[21] Appl. No.: 41,506

[22] Filed: Apr. 23, 1987

[30] Foreign Application Priority Data

Apr. 24, 1986 [IT] Italy ..... 85541 A/86

[51] Int. Cl.[4] ..... F02P 3/01; F02P 5/145

[52] U.S. Cl. ..... 123/606; 123/418; 123/608; 123/629; 123/633; 123/643

[58] Field of Search ..... 123/606, 607, 608, 640, 123/643, 143 B, 618, 629, 415, 633, 418, 169 E

[56] References Cited

U.S. PATENT DOCUMENTS

| | | | |
|---|---|---|---|
| 1,225,535 | 5/1917 | Varley | 123/640 |
| 2,180,704 | 11/1939 | Dietrich et al. | 123/633 |
| 3,202,146 | 8/1965 | Short et al. | 123/415 |
| 4,078,534 | 3/1978 | Mayer | 123/633 |
| 4,359,998 | 11/1982 | Topic | 123/606 |
| 4,366,801 | 1/1983 | Endo et al. | 123/606 |
| 4,446,842 | 5/1984 | Iwasaki | 123/606 |
| 4,567,874 | 2/1986 | Rouanes | 123/606 |
| 4,676,218 | 6/1987 | Nozeran et al. | 123/618 |

*Primary Examiner*—Andrew M. Dolinar

*Attorney, Agent, or Firm*—Sughrue, Mion, Zinn, Macpeak, and Seas

[57] ABSTRACT

The present invention relates to an electronically-controlled plasma ignition device for internal combustion engines. A device according to the invention is characterized in that it includes the same number of high-frequency electrical-current generators as the number of cylinders in the internal combustion engine, each of the high-frequency electrical-current generators being connected electrically to the primary winding of a respective electrical coil with a high transforming ratio, whose secondary winding is connected electrically to a spark plug located in the corresponding cylinder; each of these high-frequency electrical-current generators being activated transitorially, in correspondence with the combustion phase in the respective cylinder, by control means sensitive to the rotation of the drive shaft, and possibly also to the load applied, in order to generate and maintain an electronic plasma produced by a beam of high speed electrons having a high heating effect between the electrodes of the respective spark plug, during the whole period of activation. This electronic plasma optimizes combustion, increasing the overall efficiency of the engine and decreasing pollutant emissions.

14 Claims, 5 Drawing Sheets

ELECTRONICALLY-CONTROLLED PLASMA IGNITION DEVICE FOR INTERNAL COMBUSTION ENGINES

The present invention relates to an electronically-controlled plasma ignition device for internal combustion engines.

The primary purpose of the present invention is to design an ignition device for an internal combustion engine which, by virtue of its particular characteristics, is able to optimise combustion under all operating conditions of the engine so that, by increasing the overall efficiency, it achieves a perceptible improvement in performance under all conditions, with a simultaneous decrease in fuel consumption, associated with a drastic reduction in pollutant emissions.

Within the overall scope of the invention as set out above, a particular object is to devise a completely-electronic-control device which, being free from limitations inherent in mechanical parts, is able to maintain an adequate sparking potential at all rates of revolution and which responds rapidly, in real time, to the changing operating conditions of the engine.

Not least is the object of designing a device which, whilst offering the greatest guarantee of reliability and safety in use, has a simplified and easily obtainable structure based on a limited number of components which can be assembled rapidly without requiring complicated constructional methods so that it is also competitive from an economic point of view.

The purpose described above, as well as the objects stressed and others which will become more apparent below, is achieved according to the invention by an electronically-controlled plasma ignition device for an internal combustion engine, characterised in that it includes the same number of high-frequency electrical-current generators as the number of cylinders in an internal combustion engine, each of these high-frequency electrical-current generators being connected electrically to the primary winding of a respective electrical coil with a high transforming ratio, the secondary winding of which is connected electrically to a spark plug located in the corresponding cylinder, the high-frequency electrical-current generators each being activated transitorially in correspondence with the combustion phase in the respective cylinder by control means sensitive to the rotation of the drive shaft of the internal combustion engine, and possibly also to the load applied, to generate and to maintain an electronic plasma produced by a beam of high speed electrons having a high heating effect between the electrodes of the respective sparking plug during the whole time of activation.

Further characteristics and advantages of the invention will become more apparent from the description of a preferred but not exclusive embodiment of the device, illustrated purely by way of a non-limiting example in the appended drawings, in which.

Figure 1:
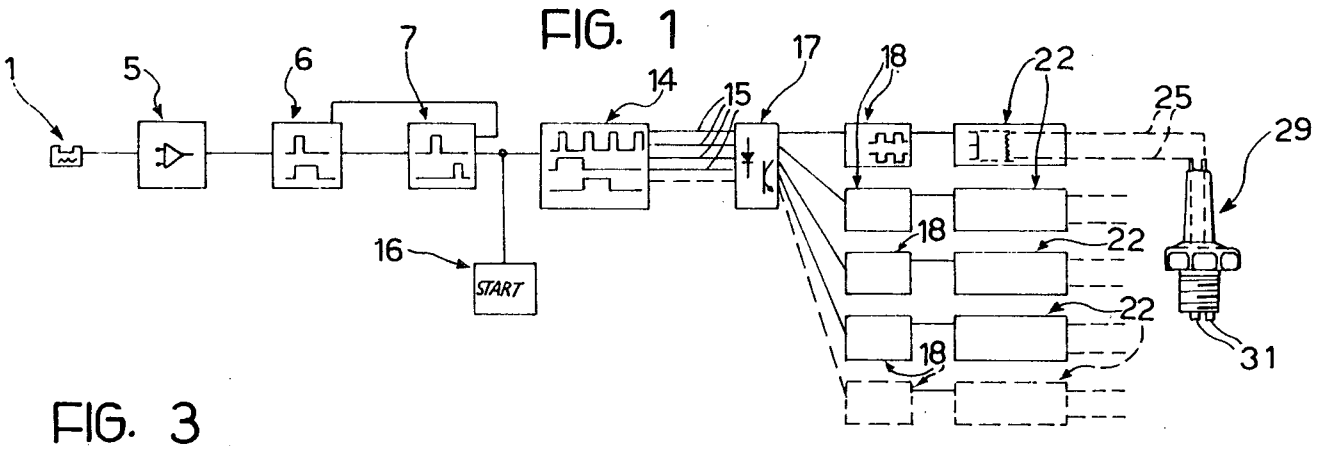
FIG. 1 is a block diagram of the device, in which the connections between the various components are indicated.

With reference to the drawings, an electronically-controlled plasma ignition device according to the invention for internal combustion engines includes control means which include a sensor for sensing the rotation of the drive shaft, consisting for example of a light-emitting diode 2 and a photodiode 3, or a phototransistor, supported on opposite sides of a disc 4 fixed to the drive shaft for rotation therewith.

The disc 4 has apertures which are distributed angularly in relationship with the firing angle of the engine (in the case of a four-cylinder, in-line engine, for example, there would be two apertures spaced at 180° from each other); these apertures are conveniently positioned in phase with the drive shaft itself.

The output of the rotation sensor 1 is connected electrically to the input of a squaring device 5 with hysteresis, consisting, to advantage, of a differential feedback amplifier with a high response speed.

Following the squaring device 5, one or more monostable devices 6, for example of the TTL or C-MOS type, are connected electrically in cascade and interact with an electronic advance variator 7 which varies the resistance of one of the monostable devices 6 suitably, either gradually or instantaneously, in response to variations in the rate of revolution of the engine.

Figure 2:
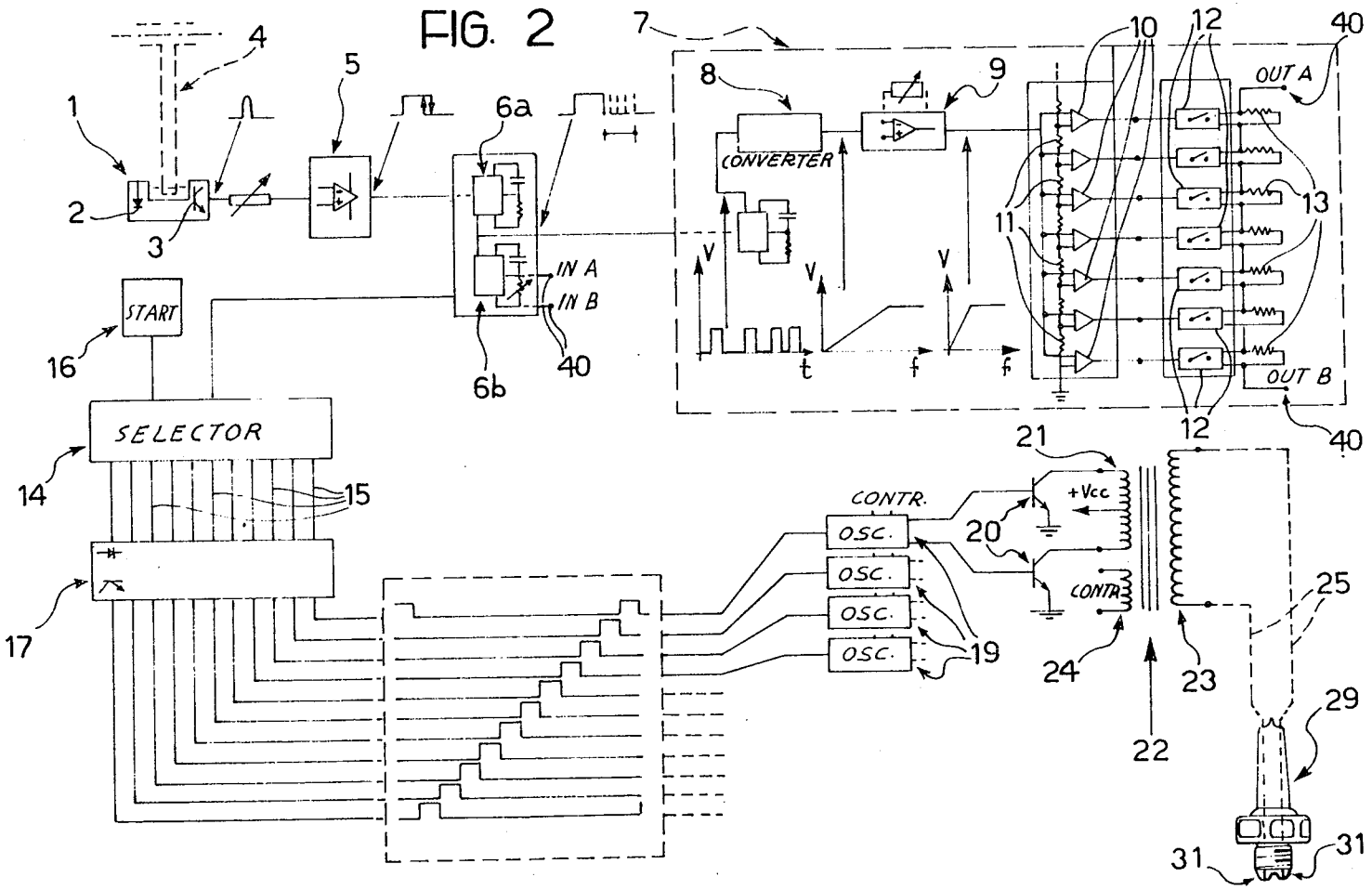
FIG. 2 is a functional plan of the device of FIG. 1.
Figure 5:
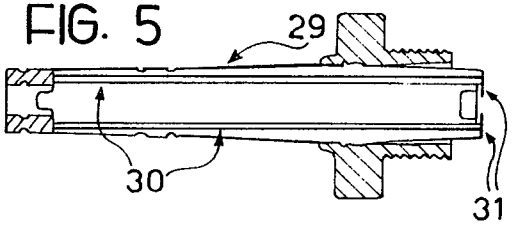
FIG. 5 is a longitudinal section of one particular spark plug and of its connector, suitable for use in association with the device of the present invention.

As is better shown in FIG. 2, in the embodiment described, the electronic advance variator 7 conveniently comprises a frequency-voltage convertor 8 which receives a signal whose frequency is directly proportional to the rate of revolution of the engine and which is followed by a variable-gain amplifier 9 whose output raises the voltage at the base of a series of operational amplifiers 10, of which there is a greater number, the better the resolution required, releasably connected with the interposition of a first series of resistors 11. The operational amplifiers 10, when conductive, activate a corresponding number of solid-state, logic switches 12 which short circuit the ends of a second series of resistors 13, modifying the resistance which controls the delay time of a monostable device 6.

Figure 7:
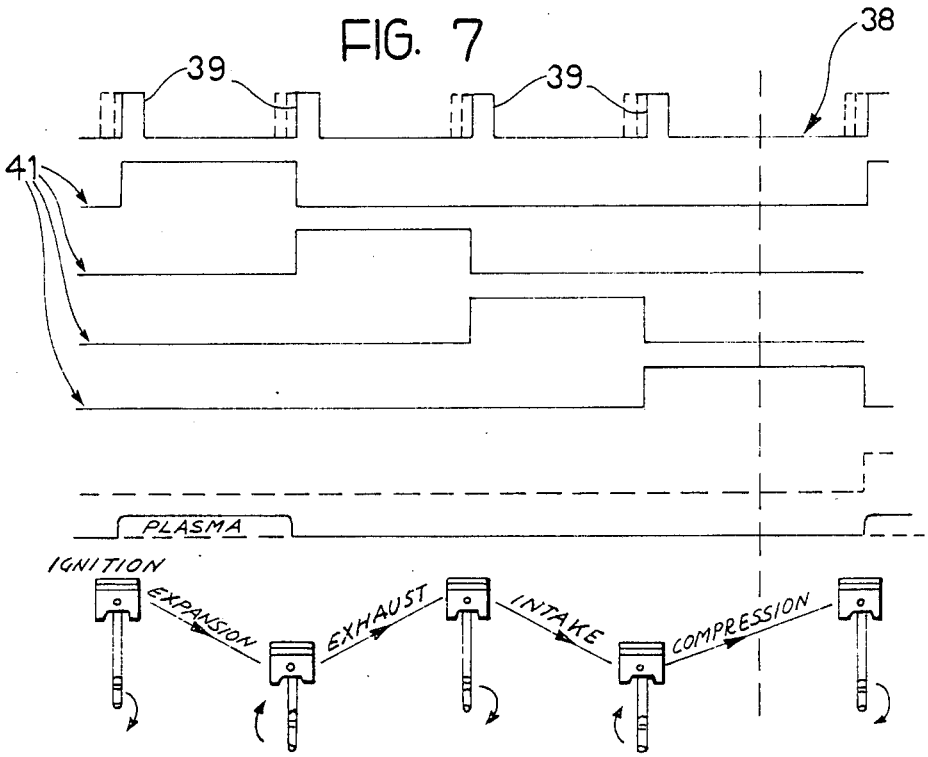
FIG. 7 is a diagram illustrating the transformation of the signal input to the selector device to the signal present at its outputs as a function of the angular position of the drive shaft.
Figure 8:
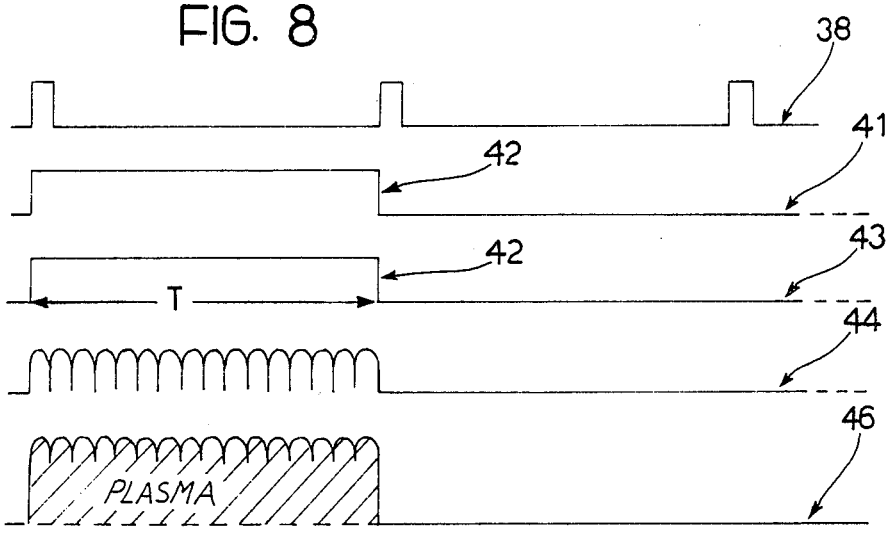
FIG. 8 is a schematic diagram showing the electrical currents in the coil, and the resulting electronic plasma produced between the electrodes of the plug, in relation to the signal input to the respective high-frequency electrical current generator as a function of the angular position of the drive shaft.

Following the monostable devices 6 is a selector device 14 for selecting the cylinder in which combustion is to occur, which consists, essentially, of a counting unit and a system of logic gates interconnected in such a way that, as shown in FIG. 7, a signal is present at each of the outputs 15 of which there are the same number as the number of cylinders of the engine.

The control means can further conveniently include a start signalling device 16 which, at the end of each operating cycle of the engine, sends a synchronising signal to the selector device 14 to trigger the counting unit at a certain angular position of the drive shaft.

The outputs 15 of the selector device 14 constitute the outputs of the control means according to the invention and are each conveniently connected to subsequent stages with the interposition of respective photocouplers 17.

Figure 4:
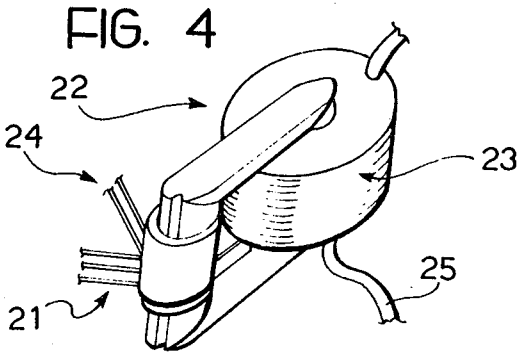
FIG. 4 is a perspective view of a preferred embodiment of a coil according to the invention.
Figure 3:
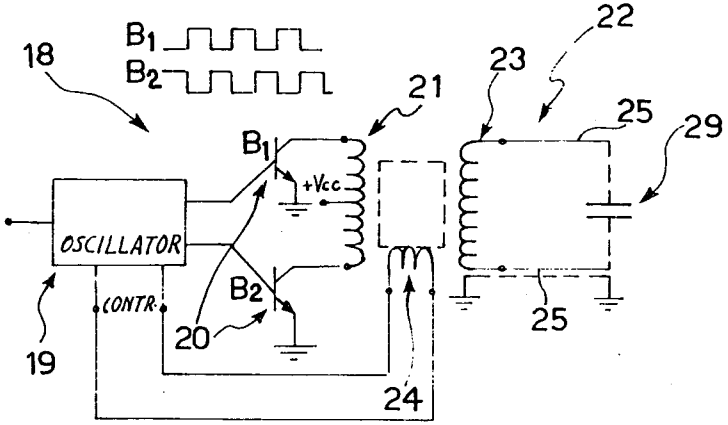
FIG. 3 is an electrical diagram relating to the connections between one of the high-frequency electrical-current generators and the respective coil and plug.

Each output 15 is connected to a corresponding high-frequency electrical-current generator 18, each of which, to advantage, consists of an oscillator 19 which, as best seen in FIG. 3, has two outputs 180° out of phase with each other which drive in counterphase the bases of two power transistors 20 connected in a "push-pull" arrangement. The load on the two transistors 20 is the centre-tap primary winding 21 of an electrical coil 22 with a high transforming ratio which, as shown in FIG. 4, has a rectangular-shaped ferrite core and a secondary winding 23 with a very high number of turns in relation to that of the primary winding 21.

The coil 22 preferably also has an auxiliary winding 24 connected to two load-monitoring inputs of the respective oscillator 19.

According to a preferred embodiment of the invention, the ends of the secondary winding 23 of the coil 22 are connected to two electrical conductors 25 which are brought together in a high-insulation cable 26 and which are connected at their opposite ends to a connector 27 with two contacts 28; this connector 27 is suitable for attachment to a spark plug 29 which in accordance with the invention, is provided with two conductor rods 30 which are isolated from each other and which can each be connected at one end to the connector 27 and the other ends of which, within the cylinder, form two electrodes 31, both isolated form the engine block and thus from the earth of the circuit.

From what has been described, the operation of an electronically-controlled plasma ignition device according to the invention can be summarised as follows.

Figure 6:
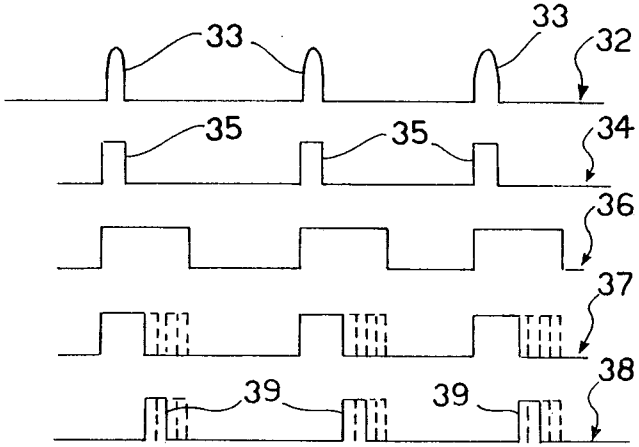
FIG. 6 is a diagram illustrating the changes in the signal detected by the rotation sensor and the signal input to the selector device at a constant rate of rotation as a function of the angular position of the drive shaft.

The drive shaft rotation sensor 1 produces a pulsed signal which has a wave form indicated by reference numeral 32 in FIG. 6, in which the frequency of peaks 33 is directly proportional to the rate of rotation of the engine and in which each peak corresponds to the passage of one of the pistons, during its compression phase, through a predetermined angle with respect to the top-dead-centre point (TDC).

The signal 32 passes to the squaring device 5 with hysteresis, which processes the signal, separating it from any undesirable harmonics, and transforming it into the wave form indicated 34; the signal 34, thus manipulated, passes to the monostable devices 6 each of which prolongs the duration of each input pulse 35 by a length of time determined by the combination of the values of the capacitative and resistive components connected in parallel with it.

Conveniently, there can be a first monostable device **6*a* in which the R-C components are constant and which always displaces the leading edge of the pulses 35 by the same value, giving rise to a signal 36, and a second monostable device 6*b* in which the value of at least one of its R-C components is varied by the electronic advance variator 7 in accordance with the prevailing operating conditions of the engine so that this monostable device 6*b* generates a signal 37 whose leading edge is displaced by a value which changes as the operating conditions of the engine vary. The two signals 36 and 37 generated by the two monostable devices 6*a* and 6*b* are then recombined, giving rise to a compound signal 38 in which the output pulses 39 still have almost the same duration as the input pulses 35** but which are advanced relative to the latter by an amount which varies with the changes in the operating conditions of the engine, giving rise to the necessary dynamic advance.

The operation of the electronic advance variator 7 can, in its turn, be summarised, it being observed that the input of the frequency-voltage converter 8 receives the same signal 34 in which the frequency of the pulses 35 clearly increases as the rate of revolution of the engine increases; consequently the voltage output by the converter will increase and, after being brought by the variable gain amplifier 9 to the specific advance requirements of the engine, will be applied to the inputs of the operational amplifiers 10. As the output voltage of the converter 8 increases above predetermined thresholds dependent on the values of the first series of resistors 11, the operational amplifiers pass successively, one after the other, from their passive to their active states (or vice versa as the voltage decreases), consequently opening (or closing) the logic switches 12 controlled by them; obviously, as the state of each logic switch 12 varies, the resistance between the terminals 40 varies and thus the delay time of the relative monostable device **6*b*** varies.

The compound signal 38, together with the synchronisation signal produced by the start signalling device 16, reaches the selector device 14 which processes it, distributing, in rotation, a signal of the type indicated 41 in FIG. 7 to the individual outputs 15 the signal 41 having a control pulse 42 which begins with the leading edge of the pulse at the input concerned with the respective cylinder (i.e. in the case of four cylinders, one pulse in four) and ends, for example, at the arrival of the next pulse, then remains constantly at zero through the whole of the remaining period.

Each output 15 thus produces a signal 41 which carries a control pulse 42 which begins at the appropriate stage of advance before TDC of the compression in the cylinder and is maintained for the whole of a predetermined angle of rotation of the drive shaft, for example for the entire period between two successive firings of the engine (and thus for a rotation of 180° in the case of a four cylinder engine).

Each output 15 of the selector device 14 pilots an oscillator 19 through the photocouplers 17 which transmit the signal exactly without modification and which carry out the protective function of connection the digital control stage to the subsequent power stage by optical means, thus keeping the two circuits electrically separated.

A pilot signal 43, identical to the signal 41 at the respective output 15 of the selector device 14, reaches each oscillator 19 which, for the whole duration of the control pulse 42, produces a very high frequency signal at its outputs; it should be stated, on the other hand, that, for the remaining period during which there is no control pulse, the oscillator 19 is inactive and does not absorb energy.

The two subsequent power transistors 20 practically double the frequency generated by the respective oscillator 19 and apply an electrical signal of the type indicated 45 to the primary winding 21 of the respective electrical coil 22 so that, during the whole period of activation of the respective oscillator 19, a corresponding very-high-frequency, high-voltage electrical current is supplied to the secondary winding 23, with the waveform indicated by the reference numeral 46.

The output 46 of the secondary winding 23 is thus carried by the cable 26 to the plug 29, causing a voltaic arc to be struck between its two electrodes 31, this arc being maintained throughout the period of activation of the respective oscillator 19, that is, with reference to the rotation of the drive shaft, from the angle of advance relating to the prevailing rate of revolution up to a large angle of expansion, giving rise to a continuous plasma of high-speed electrons having a high heating effect which is manifested as an enormous capacity to initiate, and subsequently to encourage, combustion of the mixture introduced.

It should be mentioned that the intensity of the signal generated by the oscillator is controlled by means of the auxiliary winding 24 in dependence on the load on the secondary winding 23, in such a way as to maintain a constant output from the secondary winding even when the resistance between the two electrodes 31 varies.

Figure 9:
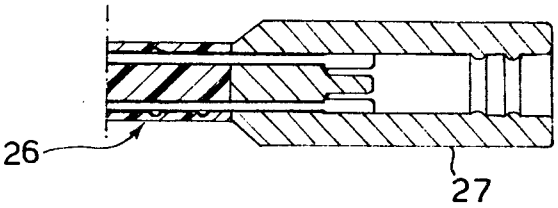
FIG. 9 is a schematic drawing illustrating a preferred arrangement of the components of the ignition device in the motor vehicle.
Figure 9:
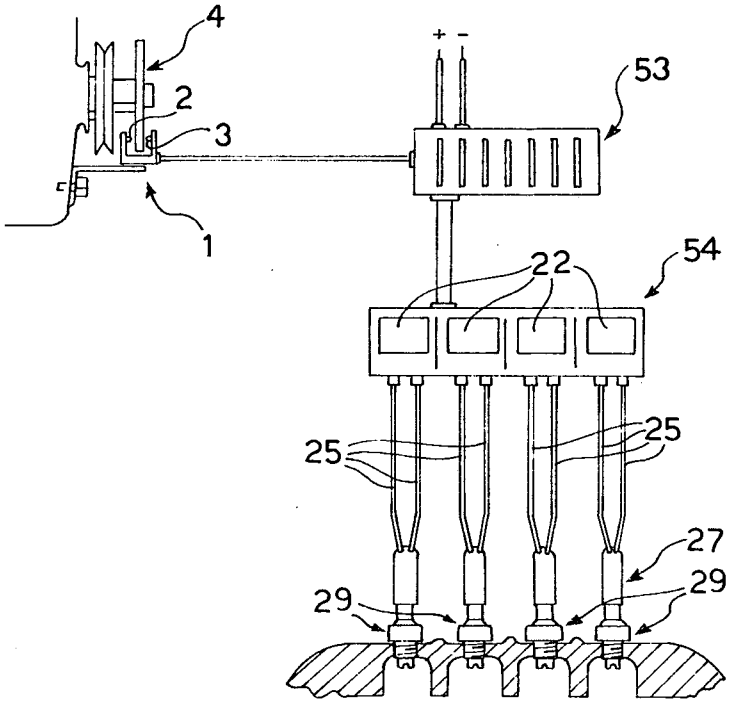

As illustrated schematically in FIG. 9, in a practical embodiment of the device, a first block 53 can be provided which encloses all the components, with the obvious exception of the rotation sensor 1 and the coils which can conveniently be housed in a second block 54 positioned near to the spark plugs; the first block 53 will be supplied by the electrical system of the vehicle.

Figure 10:
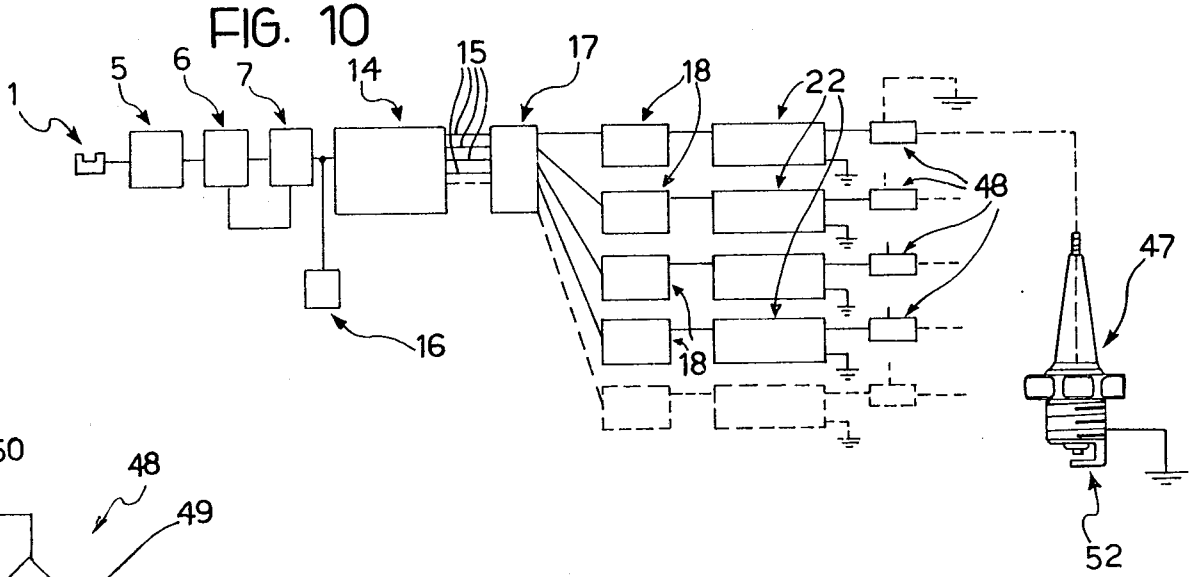
FIG. 10 is a block diagram of a variant of the ignition device relating to the use of a conventional plug.

Although the use of a plug 29 with two electrodes 31 which are not connected to earth can improve the characteristics of the ignition device according to the invention, a conventional spark plug can, however, be used, as shown by the variant of FIG. 10, in which the same reference numerals refer to component parts equivalent to those already described.

Figure 11:
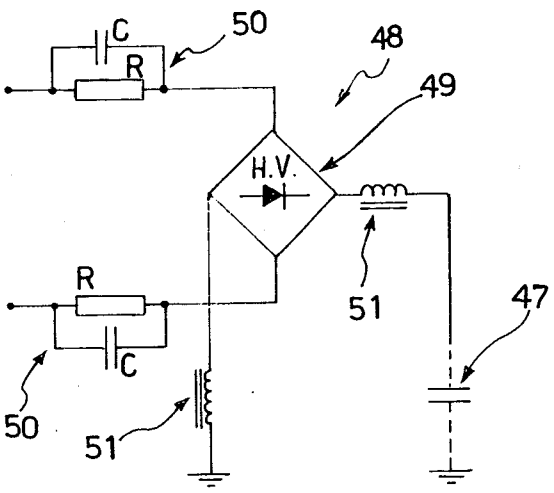
FIG. 11 is an electrical diagram of a limiting device shown in the block diagram of FIG. 10.

This variant differs from the preferred embodiment explained above in that it has a limiting device 48 between each coil 22 and the respective, conventional plug 47, an example of whose electrical layout is shown in FIG. 11. Conveniently the limiting device 48 comprises a high-voltage diode bridge 49 connected to the secondary winding 23 via R-C circuits 50 with inductors 51 at its opposite vertices; this limiting device 48 fulfils an antiresonance function and, by attenuating the voltage peaks, avoids disturbances being transmitted to the electrical system of the vehicle through the earthed electrode 52 of the plug 47.

It has thus been confirmed, in practice, that the electronically-controlled plasma ignition device of the invention enables a high-power electrical spark to be maintained in the combustion chamber for the whole of the period dictated by the control means, which is first able to trigger combustion efficiently on a broad front and then encourages the maintenance of a more efficient and complete combustion, with the result that the combustion process is notably optimised.

The ignition power of the plasma beam between the plug electrodes means that it is fully able to trigger efficient combustion under all running conditions of the engine, even at higher speeds, and also enables large quantities of fuel which are admitted suddenly into the cylinders, for example due to sudden pressure on the accelerator, to be burnt smoothly; an appreciable improvement in the performance of the engine is thus obtained under all conditions, this being particularly apparent even in the case of abrupt accelerations combined with heavy loading of the engine.

Furthermore, the improved combustion obtained results in more complete utilization of the fuel introduced into the cylinders and thus permits the fuel consumption to be reduced appreciably for the same performance.

The considerable ability to activate combustion manifested by the permanent electric arc, as well as enabling mixtures even with ratios other than the optimum to be ignited without difficulty, also allows the engine to be supplied with poor quality fuels, for example with less additives, which are thus cheaper. It is also important to note that, as a direct consequence of the phenomena described above, the use of a device according to the invention permits the pollutant emissions from an engine to be reduced appreciably with the practical elimination of unburnt fuel from the exhaust gases and immediate, beneficial results from the point of view of reducing atmospheric pollution; moreover, a further possible improvement in this field could be obtained simply by the suitable calibration of the control means, for example, so as to modify the duration of the arc or by the activation of supplementary arcs between the plug electrodes during the exhaust phase to complete the combustion of any imflammable residues even during expulsion of the gas. And furthermore, in addition to the principal results mentioned above, the more homogeneous and gradual combustion obtained produces reduced pressure waves, with clear reductions in the noise and vibrations produced by the engine.

It will also be noted that the absence of mechanical components, replaced completely by electronic parts, as well as allowing the device to operate in real time, without delays or disruptions, makes the device itself extremely safe and reliable, and free from the need for maintenance or regulation, with practically unlimited life, as well as being cheap to manufacture; a further consequence of the use of electronic components is that this provides practically unlimited possibilities for the regulation of the ignition advance, whether static or dynamic, also enabling the device easily to be made sensitive to other prevailing operating factors of the engine.

All that part of the device which precedes the coil can, moreover, be supplied at low voltage from the electrical system of the vehicle, the only increase in voltage occurring at the coil and with very great efficiency due both to the particular structure of the coil itself and the fact that the increase in voltage is not produced by sudden transitory phenomena but rather by the transformation of a high-frequency alternating current.

The invention thus conceived can have numerous modifications and variants, all falling within the scope of the innovative concept.

Thus, for example, the optical rotation sensor 1 could be replaced by other sensors, for example, of the magnetic type; the electronic advance variator could have a different structure and could possibly consist of electronic components already present in the vehicle, could operate continuously or intermittently for short or long periods and be connected to other monitoring devices to make it sensitive, for example, to the load applied to the engine, to the performance required, etc; the photocouplers 17 could be eliminated or replaced by a similar connection system; and further, oscillators with a single output combined with a transistor and a diode connected in a "fly-back" arrangement could be used as the means for generating the high-frequency electrical current.

There can be any number of outputs 15 from the selector device 14, depending obviously on the number of cylinders in the engine; each output will however be followed by an identical succession of components.

For this reason, in the appended drawings, the components relating to one of the cylinders have been shown fully and further possible outputs have been shown by dotted lines.

Furthermore all the parts can be replaced by other technically equivalent components and, in practice, the materials and dimensions used can be varied at will to comply with requirements and the state of the art provided they are compatible with the use in question.

What is claimed is:

1. An electronically-controlled plasma ignition system for an internal combustion engine, including at least one spark-plug for each cylinder of the engine, sensor means for monitoring the rotation of the drive shaft of the engine, a plurality of coils having each a primary winding and a secondary winding; the secondary winding of each coil being coupled to a respective spark-plug;

a plurality of high frequency electrical-current generators each connected to the primary winding of a respective coil; and electronic control means coupled to said sensor means, for activating each of the high frequency electrical-current generators in correspondence with the combustion phase in the corresponding cylinder to generate an electronic plasma between the electrodes of the associated spark-plug;

each of the said coils including a respective auxiliary winding magnetically coupled to the secondary winding for providing a signal which is indicative of the impedance between the electrodes of the associated spark-plug;

each of said high frequency electrical current generators including an oscillator coupled to the primary winding and the auxiliary winding of the associated coil; each of said oscillators being adapted to apply to the primary winding of the corresponding coil a signal having an intensity which is variable as a function of the signal provided by the associated auxiliary winding, so as to maintain in each combustion phase a substantially constant plasma-flow between the electrodes of the associated spark-plug.

2. An ignition device according to claim 1, wherein said control means include a rotation sensor for the drive shaft connected electrically to a signal squaring device with hysteresis, which is electrically connected to at least one monostable device electrically connected to a selector device for selecting the cylinder concerned with combustion, the outputs of which are each connected to one of said high-frequency electrical-current generators.

3. An ignition device according to claim 2, wherein said signal-squaring device with hysteresis consists of a differential feedback amplifier.

4. An ignition device according to claim 2, wherein said device for selecting the cylinder concerned with combustion consists essentially of a counter unit and a system of logic gates.

5. An ignition device according to claim 2, wherein said control means include an electronic variator for varying the advance, which modifies a resistance connected to at least one said monostable device according to the variation in the rate of revolution of said engine.

6. An ignition device according to claim 5, wherein said electronic advance variator comprises a frequency-voltage converter, followed by variable-gain amplifier, whose output raises the voltage at the base of a series of operational amplifiers releasably connected and in association with a first series of resistors, said operational amplifiers controlling a corresponding number of logic switches adapted to short-circuit the ends of a second group of resistors connected to one said monostable device.

7. An ignition device according to claim 2, wherein said control means comprise a start signalling device which, at the completion of each operating cycle of other engine, sends a synchronising signal to said selector device.

8. An ignition device according to claim 2 wherein each output of said selector device is connected to the respective high-frequency electrical-current generator through a photocoupler.

9. An ignition device according to claim 1, wherein said high-frequency electrical-current generators consist essentially of an oscillator having two outputs which are 180° out of phase with each other and each of which pilots, in counterphase, the bases of a pair of power transistors whose load is said primary winding which has a centre tap.

10. An ignition device according to claim 1, wherein each said high-frequency electrical-current generator consists essentially of an oscillator with a single output connected to a transistor and a diode in a fly-back arrangement.

11. An ignition device according to claim 1, wherein said electrical coil comprises a ferrite core with a substantially rectangular periphery surrounded by the primary winding and the secondary winding, the latter having a very much larger number of turns than the primary winding.

12. An ignition device according to claim 1, wherein said plug includes two conductor rods electrically isolated from each other and terminating, at their ends within the cylinder, in two electrodes both isolated from earth and between which the electronic plasma is produced, the conductor rods being connectible at their opposite ends to a connector with two contacts connectible electrically to the ends of the secondary winding.

13. An ignition device according to claim 1, including, between each coil and the respective conventional plug, a limiting device adapted to filter out high-frequency disturbances transmitted to the vehicle when conventional spark plugs are used.

14. An ignition device according to claim 13, wherein said limiting device includes a high-tension diode bridge with R-C circuits at its inputs and with reactive filter elements arranged at its opposite vertices.

* * * * *